US005809456A

United States Patent [19]

Cucchi et al.

[11] Patent Number: 5,809,456

[45] Date of Patent: Sep. 15, 1998

[54] VOICED SPEECH CODING AND DECODING USING PHASE-ADAPTED SINGLE EXCITATION

[75] Inventors: Silvio Cucchi, Gaggiano; Marco Fratti, Milano, both of Italy

[73] Assignee: Alcatel Italia S.P.A., Milan, Italy

[21] Appl. No.: 670,510

[22] Filed: Jun. 27, 1996

[30] Foreign Application Priority Data

Jun. 28, 1995 [IT] Italy ..... MI95A1379

[51] Int. Cl.[6] ..... G10L 9/08

[52] U.S. Cl. ..... 704/217; 704/219; 704/263

[58] Field of Search ..... 395/2.28, 2.16, 395/2.71, 2.24, 2.2, 2.32, 2.73, 2.26; 704/216, 219, 262, 265, 215, 211, 223, 264, 217, 263, 266

[56] References Cited

U.S. PATENT DOCUMENTS

| | | | |
|---|---|---|---|
| 4,908,863 | 3/1990 | Taguchi et al. | 395/2.58 |
| 5,067,158 | 11/1991 | Arjmand | 395/2.76 |
| 5,517,595 | 5/1996 | Kleijn | 395/2.14 |

FOREIGN PATENT DOCUMENTS

| | | |
|---|---|---|
| 608174A | 7/1994 | European Pat. Off. . |
| 610906A | 8/1994 | European Pat. Off. . |
| 9423426 | 10/1994 | WIPO . |

OTHER PUBLICATIONS

"Method for waveform interpolation in speech coding" by W.B. Kleijn, Digital Signal Processing, pp. 215–230, Sep. 1991.(Cited twice).

"Code–Excited Linear Prediction (CELP); High Quality Speech at Very Low Bit Rates" Proceedings of the International Speech & Signal Processing,Schroeder et al 1985,pp. 937–940.

"Multiband Excitation Vocoder" by Griffin, et al. IEEE Transaction of Acoustic, Speech and Signal Processing, pp. 1223–1235, Aug. 1988.

"The Goverments Standard, Linear Predictive Coding Algorithm: LPC–10", Speech Technology, pp. 40–49, Apr. 1982. T. Tremain.

"Excitation Modelling Based on Speech Residual Information" by Lupini et al, Proc. Int'l Conference on Acoustic, Speech and Signal Processing, pp. 333–336, 1992.

Kluwer Academic Publishers. Gersho et al, "Vector Quantization and Signal Processing". pp. 110–111, 1992.

*Primary Examiner*—Richemond Dorvil

*Attorney, Agent, or Firm*—Ware, Fressola, Van Der Sluys & Adolphson LLP

[57] ABSTRACT

The present invention relates to a method and to equipment for coding and decoding a sampled speech signal. It belongs to systems used in speech processing, in particular for compression of speech information. The method is based upon a time/frequency description and on a representation of the prototype as a fundamental period of a periodic waveform; moreover the excitation of the synthesis filter is carried out through a single, phase-adapted pulse.

10 Claims, 3 Drawing Sheets

VOICED SPEECH CODING AND DECODING USING PHASE-ADAPTED SINGLE EXCITATION

TECHNICAL FIELD

The present invention relates to a method and to associated equipment for coding and decoding a sampled, periodic, speech signal. It is used in systems for speech processing, in particular for compression of information.

BACKGROUND OF THE INVENTION

Therefore, it is a method of coding periodic waveforms constituting the "voiced" component of the speech signals. It is known that a voiced component contains a periodic (or semiperiodic) repetition of a fundamental waveform which is often called a "prototype" in the literature (see, e.g., the article by W. B. Kleijn: "Method for waveform interpolation in speech coding", Digital Signal Processing, pages 215–230, September 1991).

From the literature, the methods of representation, parameterization and coding the voiced component are generally subdivided into two classes:

1) Representation and coding in the time domain

2) Representation and coding in the frequency domain.

Class 1. The coders operating in the time domain are generally based upon Linear Predictive Coding (LPC) algorithms.

In this case the spectral components of the waveform are determined on the basis of signal segments having generally fixed length, such length not being tied in any way to the prototype length. The spectral components are univocally represented by a set of coefficients for a suitable digital filter, called an LPC synthesis filter. The periodicity of the waveform is generally introduced through the periodic repetition of a so-called "excitation" waveform; such a waveform constitutes the input signal for the synthesis filter. A detailed description of the operation principle of such coders can be found in the article by M. R. Schroeder and B. S. Atal, "Code-Excited Linear Prediction (CELP); High Quality Speech at Very Low Bit Rates", Proceedings of the International Speech and signal Processing, 1985 pages 937–940.

Class 2. In coders operating in the frequency domain, the spectral components of the signal are determined through suitable Fourier analysis. The periodicity of the waveform is introduced through the sum of sine-wave components having suitable amplitude and phase. The fundamental frequency of such a set of sine-waves is evidently tied to the length of the prototype.

Similar to coders operating in the time domain, the voiced waveform is analyzed and re-synthesized according to fixed-length segments, such lengths not being constrained in any way to the prototype length.

For a detailed description of such coders see e.g., the article "Multiband Excitation Vocoder" by W. Griffin and J. S. Lim, IEEE Transaction on Acoustic, Speech and Signal Processing, pages 1223–1235, August 1988.

More recently, a new encoding technique has been introduced to obtain a high-quality reconstructed voiced waveform. Such a technique is based upon representation, parameterization and coding of a single prototype (and then on a variable length voice segment). A voiced segment can be reconstructed through chaining of such a prototype, thus regenerating the necessary periodicity. More precisely, given two prototypes, temporally separated according to a certain distance, the periodic waveform between the two prototypes can be reconstructed through suitable interpolation techniques between the two prototypes. In decoding, the information describing a prototype and the interpolation parameters is, therefore, sufficient to reconstruct a voiced segment: the decoder is able to reconstruct the voiced segment by interpolation, having in storage the description of the "past" prototype and receiving from the transmission channel the description of the "present" prototype and the interpolation parameters. This coding technique is known as "Prototype Waveform Interpolation" (PWI) and is described, e.g., in the article "Methods for waveform interpolation in speech coding" by W. B. Kleijn, Digital Signal Processing, pages 215–230, September 1991.

SUMMARY OF THE INVENTION

It is an object of the present invention to provide a new method of coding speech signals which is more effective than the aforesaid methods; such method using the PWI coding technique which provides an effective and efficient method for representing, parameterizing and transmitting a prototype.

With such a coding technique it is possible to obtain good quality of the reconstructed speech (signal) at low bit rates (e.g. about 2400 bit/s).

A further advantage consists in that the coding bit rate can easily be varied as a function of the number of time/frequency parameters used for the description of the excitation signal and of the prototype extraction frequency.

In accordance with the invention this object is achieved by a method of encoding a sampled speech signal, said speech signal containing a prototype that is a periodic or semi-periodic repetition of a fundamental waveform, the method comprising the steps of taking a segment of said sampled speech signal; calculating a series of autocorrelation coefficients of said sampled speech signal segment; calculating, from said series of autocorrelation coefficients, a series of LPC coefficients, relative to a synthesis filter; determining an excitation waveform of said synthesis filter, so that the signal coming out from said filter minimizes the distortions with respect to said sampled speech signal segment; quantizing said series of LPC coefficients and said excitation waveform; and characterized in that said sampled speech signal segment has a length equal to the length of the prototype of said sampled speech signal.

It is also directed to a method of decoding a sampled speech signal comprising the steps of receiving the parameters of an LPC filter; receiving the parameters of an excitation waveform of said filter; reconstructing said waveform; reconstructing said speech signal; and characterized in that said waveform is periodicized.

It is further directed to a corresponding coder and decoder to perform such functions.

Further characteristics of the invention are set forth in the dependent claims.

BRIEF DESCRIPTION OF THE DRAWINGS

The invention will now be illustrated in greater detail with reference to the attached drawing representing a sampled periodic signal in which.

BEST MODE FOR CARRYING OUT THE INVENTION

Figure 1:
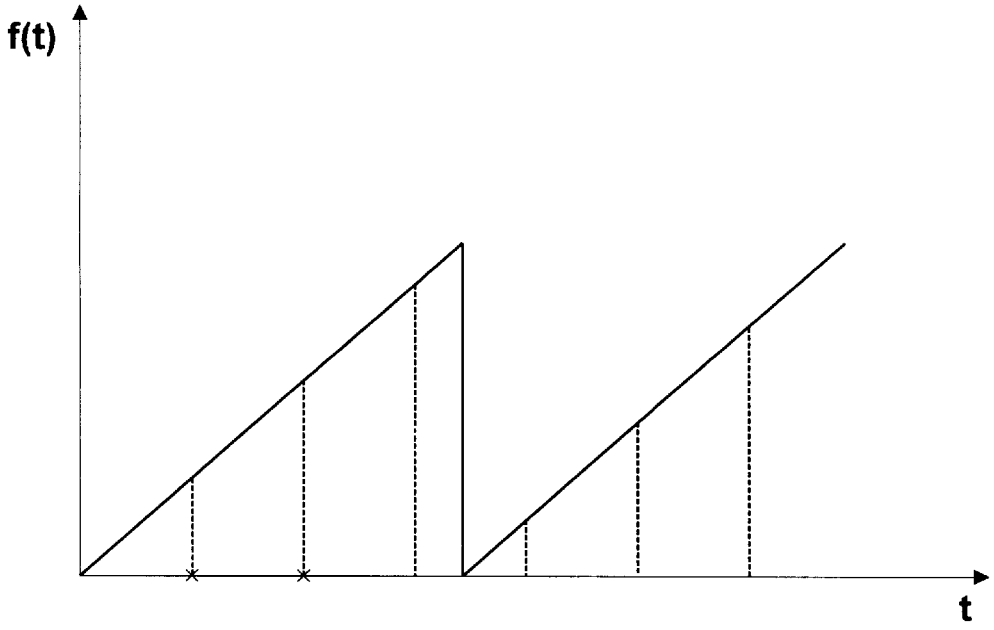
FIG. 1*a*) illustrates the case when the sampling period is not a multiple of the prototype period, while FIG. 1*b*) illustrates the case when the sampling period is a multiple of the prototype period.
Figure 1:
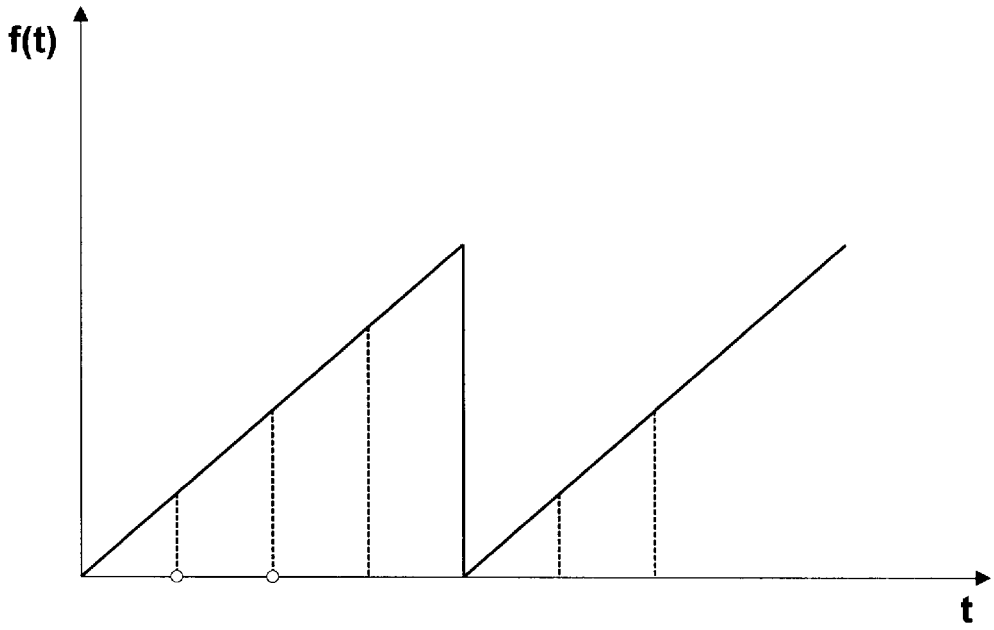

The proposed method is based upon a time/frequency description and relies on the following points: LPC representation of the prototype; excitation through single phase-adapted pulse; and an in-phase adaptation algorithm.

A detailed description of such points is given below.

It is known that the LPC representation of a waveform allows at least square estimate of the spectral envelope of the signal. In particular, the LPC coefficients of a synthesis filter generate a transfer function which generally offers a good spectral representation of the resonances present in the signal. Conventional methods of extraction of the LPC coefficients work on signal segments having fixed length. Specifically, they work along time "windows" outside of which the signal is assumed to be null. This approach generates edge effects that may involve undesired distortions in the spectral representation of the signal.

In setting a LPC representation of a prototype the assumption can be made that the prototype, is exactly the fundamental period of the periodic waveform representing the voiced segment. Under this assumption, the time "window" for calculating the LPC coefficients has a length equal to the length of the prototype itself. Moreover, the assumption that the signal is null outside such analysis window can be avoided: a periodic extension of the signal outside the analysis window allows the avoidance of the aforesaid edge effects. In particular, the correlation coefficients (necessary for calculating the filter coefficients) are calculated on the periodic extension of the signal, assuring the stability of the LPC synthesis filter. The LPC coefficients resulting from such a calculation method allow a more effective spectral representation of the prototype, the aforesaid polarization due to edge effects not being possible.

As to the excitation through a single phase-adapted pulse, conventional LPC vocoders (see, e.g. T. Tremain, "The Governments Standard, Linear Predictive Coding Algorithm: LPC-10", Speech Technology, pages 40–49, April 1982) are based upon a simple voice production model: every voiced segment is reconstructed through a sequence of pulses having a constant amplitude and at a fixed time separation; such a sequence constitutes the input of the suitable LPC synthesis filter. The pulse train so defined reconstructs the necessary periodicity. Therefore, it is obvious that, in principle, a single pulse (having suitable amplitude and position) can constitute the excitation to one LPC filter described in paragraph 2b). In fact, the prototype is nothing else than a fundamental period of the voiced waveform. The determination of such pulse must, on the other hand, take into account the fact that the prototype is ideally periodicized, as it is done for calculating the LPC coefficients. These coefficients (LPC coefficients, single pulse) then constitutes the synthesis model of a waveform (prototype) defining the fundamental period of a voiced segment. The amplitude and the position of the single pulse must then be calculated "at regime": a train of pulses, separated from each other by a fixed distance (period) and equal to the length of the prototype are transmitted to the input of the LPC synthesis filter, allowing the reconstruction, after a number of periods, of the fundamental waveform (prototype). In practice, it has been observed that few repetitions (3 or 4) of the pulse are sufficient to bring the synthesis filter into a steady state. Such a prototype reconstruction model, combined with a suitable PWI technique, allows the reconstruction of a voiced segment with an accuracy much higher than methods based upon the conventional LPC-10 synthesis model described above.

The above-described synthesis model, even if substantially improving the state of the art, is suitable to be further improved in order to obtain a high quality reconstruction of the prototype. In fact, it is known that the LPC synthesis filter is a minimum phase filter, while the prototype is not. In general, a prototype synthesis system (based on single pulse, LPC filter) can assure a good reconstruction of the magnitude of the prototype spectrum, but not of its PHASE.

One way to solve this problem and then to further improve the quality is to vary, in a suitable manner, the phase spectrum of the single pulse (a single pulse is characterized by a Fourier transform having a constant magnitude and linear phase). Therefore, given a constant spectrum (representative of a single pulse in zero position), it is a question of finding suitable values of the phase spectrum, in such a way that the reconstructed prototype is "close" to the original prototype, according to a certain error criterion. The considerations made previously on the prototype reconstruction (periodic repetition of a suitable excitation, LPC synthesis filter calculated on the periodicized prototype) are still valid; the excitation signal is parameterized in a more complete manner, however, by describing it in terms of a suitable waveform obtained through suitable variations of the phase spectrum of a single pulse.

The description of the excitation original is then made through a suitable phase spectrum, a position and an amplitude.

In the following, techniques are described for suitably varying the phase spectrum of the single pulse ("in phase" adaptation problem).

Recently, attempts have been made to adapt in phase the spectrum of a generic excitation signal of the LPC filter. In particular, in the article "Excitation Modelling Based on Speech Residual Information" by P. Lupini and V. Cuperman, Proc. International Conference on Acoustic, Speech and Signal Processing pages 333–336, 1992, an in-phase adaptation algorithm is disclosed in which the phase samples used are those of the prediction residual, and the excitation to the LPC filter derives from random noise segments of Gaussian probability density (as in conventional CELP coders).

Such an algorithm, even though giving good results, derives from purely experimental considerations; in general, it is uncertain whether it is correct to use the information deriving from the prediction residual as phase information. More specifically, the phase samples for the adaptation should be determined according to the well known analysis-by-synthesis procedure; that is to say, the values of the phase samples should be determined in such a way that the reconstructed prototype is "close" (according to a suitable error criterion) to the original prototype.

In the present case, as said, the "starting" excitation comprises a single pulse, i.e. comprises a waveform having a constant spectrum and a linear phase-spectrum (eventually null if the pulse is in zero position). In order to obtain the desired phase adaptation, the excitation waveform must be obtained as an antitransform of a frequency signal having a constant spectrum and a non-linear phase-spectrum. The phase-spectrum is then suitably adapted according to a predefined error criterion (for instance, the least square error) with respect to the original prototype.

The phase spectrum adaptation is obtained by suitably varying the phase samples; in particular, it is possible to vary:

1) A single phase sample at a pre-established frequency
2) All the phase samples (the entire phase spectrum)
3) A group of phase samples at adjacent frequencies
4) A group of phase samples suitably spaced apart for frequency sub-groups.

In case 4), frequencies at which the in-phase adaptation is carried out can be chosen according to a suitable criteria: for instance, one could decide to adapt the values of the phase samples to the frequencies, in which the power spectrum of the LPC synthesis filter assumes the relative maximum values, or values beyond a certain threshold, etc.

For example, assume that the prototype period is equal to 30 (samples); then 30 spectrum lines (subjected to the known constraint of the Discrete Fourier Transform) are available, and then consider the frequencies f1, . . . , f15. In case 1) the phase could be varied e.g. at the discrete frequency f3.

In case 2) all the phase samples (of frequency f1 to f15) would be varied. In case 3), one could vary the phase at the samples, e.g. at frequencies f1 . . . f4.

Lastly, in case 4) one could vary the phases of the samples, e.g., at the frequencies f1, f2, f3, f5, f6, f9.

In particular, in case 4) the phase samples could be those corresponding to "significant" values of the LPC synthesis filter power spectrum (for instance, corresponding to absolute or relative maxima).

As an example of application of the phase sample adaptation method consider the circumstance in which a possible "grid" of phase value is defined (e.g.: 0°, 90°, 180°, 270°) and make a number N of phase samples vary according to such a grid. The combination of grid values that allows the minimizing distance between the original prototype and the synthetic prototype is chosen.

Moreover, in minimizing such distance, it is necessary to consider also the value of the position that the single phase adapted pulse may have. The calculation procedure can be scheduled as follows: given a number N of phase samples, each phase sample being able to vary according to a predefined grid (e.g., a grid with a step of 90°), the following algorithm is implemented:

```
Dmin = Infinity
for (phase1 = 0 to 270, step 90)
[
    . . .
        for (phaseN = 0 to 270, step 90)
        [
            Computation of the adapted pulse (phase1, . . . , phaseN)
            for (each possible position P at the adapted pulse)
            [
                synthetic prototype = f (adapted pulse, LPC filter)
                D = Distance (Original prototype, synthetic prototype)
                if (D < Dmin)
                [
                    Dmin = D
                    Save: phase1, . . . , phaseN, P
                ]
            ]
        ]
    . . .
]
```

The described algorithm can be implemented directly in the frequency domain, with a consequent increase in the calculation speed.

The extension to the case in which the prototype period is not a whole multiple of the sampling period is now described.

Since the signal processing is carried out in a discrete-time domain, the prototype is also discretized in time and is obtained through sampling of a "continuous" prototype f(t). Let P0 be the period of such a continuous prototype. The continuous prototype is sampled with a sampling period equal to T. Two cases can be identified:

1) P0 is a whole multiple of T
2) P0 is not a whole multiple of T.

Case 1) has already been described previously.

In case 2), procedures are to be used which allow the suitable pre-processing and post-processing of the sampled prototype so as to be able to apply the above-described techniques. Signal pre-processing techniques may consist in neglecting the last sample of the prototype, or in adding a sample to the prototype, according to suitable criteria. However, such techniques can be too simplifying and lead to an efficiency loss in the encoding algorithm. More sophisticated pre-processing techniques require a variation of the prototype sampling period. This can be done directly on the sampled prototype, by using known sampling frequency conversion techniques.

Therefore, consider a continuous prototype with period P0. Let the corresponding discrete prototype be obtained through sampling and let T be the sampling period. Let M be the number of samples per period P0: if P0 is not a whole multiple of the sampling period T, M is composed of an integer I and a fractional part F. If the prototype so sampled with a sampling period T1, having defined T1=P0/k, and being $k \geqq I+1$, then P0 becomes a whole multiple of the new sampling period T1.

By way of an example, consider FIG. 1. FIG. 1(*a*) shows a periodic signal f(t) having a fundamental period P0=14 (time units). If f(t) has been sampled with sampling period T=4, evidently one has:

$$M=P0/T=3.5$$

Therefore it is possible to sample again the signal adopting:

$$T1=P0/K=14/(3+1)=3.5$$

as the sampling period. In this circumstance, there are exactly four samples per period and one turns back to the case in which the fundamental period is a whole multiple of the sampling period. In changing the sampling frequency, one can also use a sampling period (case in which k>I+1). For instance, in the above example, one could use a sampling period $$T1=P0/(I+4)=14/7=2$$

This is the case of oversampling and, in general, it is not advisable since the LPC analysis may lose efficiency.

Moreover, should the band of the continuous signal allow it, it is also possible to carry out a sub-sampling by adopting the sampling period $$T1=P0/k, \text{ with } k \leqq 1.$$

In short, when the length of the prototype is not a whole multiple of the sampling period, one can proceed as follows:

1) Converting the prototype sampling period from T into T1 (pre-processing)
2) Applying the coding techniques mentioned under class 2 above.

3) Re-converting the synthetic prototype sampling period from T1 into T (post-processing).

The decoding is now described.

The decoder receives at its input the following parameters:

parameters representative of the LPC filter, values of the phase samples position of the waveform, amplitude (energy) of the waveform, length of the prototype.

Therefore, starting from a description of the excitation signal in the frequency domain (received constant spectrum and phase samples of the transforms), it operates an inverse transform thus obtaining the excitation waveform. Such a waveform is then translated by an amount equal to the received value of the position and shifted with respect to the desired amplitude (energy) value.

The synthetic prototype is calculated after a periodicization of the excitation waveform (having the received length as the fundamental period length) and then filtering of the periodicized waveform according to the LPC-filter coefficients.

The periodicization of the excitation waveform allows the state of the synthesis filter to be brought into regime; although a countless number of periodic repetitions is, strictly speaking, necessary, it has been observed that, in practice, a few (three or four) periodic repetitions are enough. Once the "current" prototype has been reconstructed and given the previously reconstructed prototype, the synthesis voiced waveform is obtained through suitable interpolation techniques, as explained in the previous example (it is evident also that the interpolation parameters must be received by the decoder).

Figure 2:
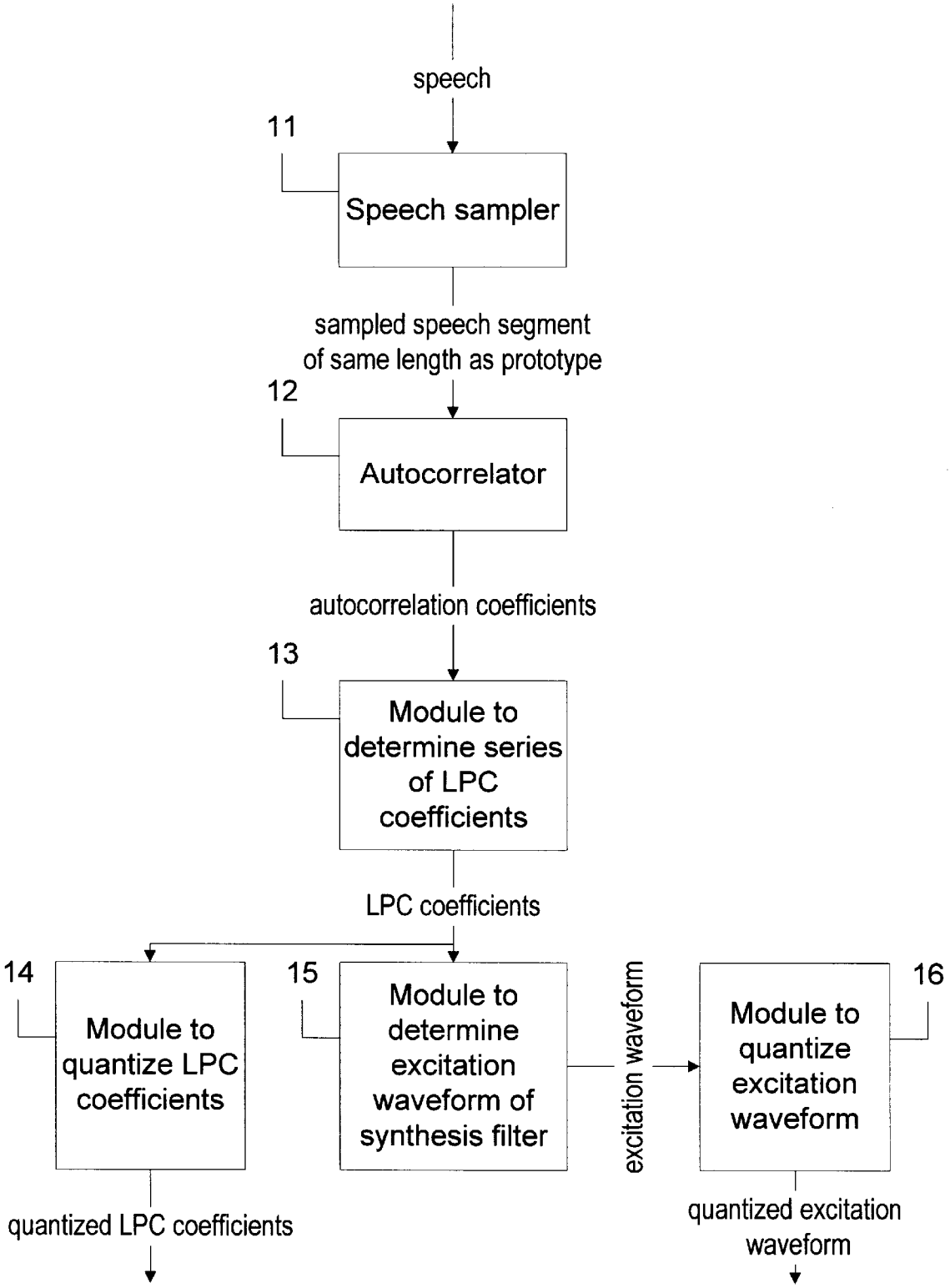
FIG. 2 shows the functional means implemented by a digital signal processor for forming a coder according to the present invention.
Figure 3:
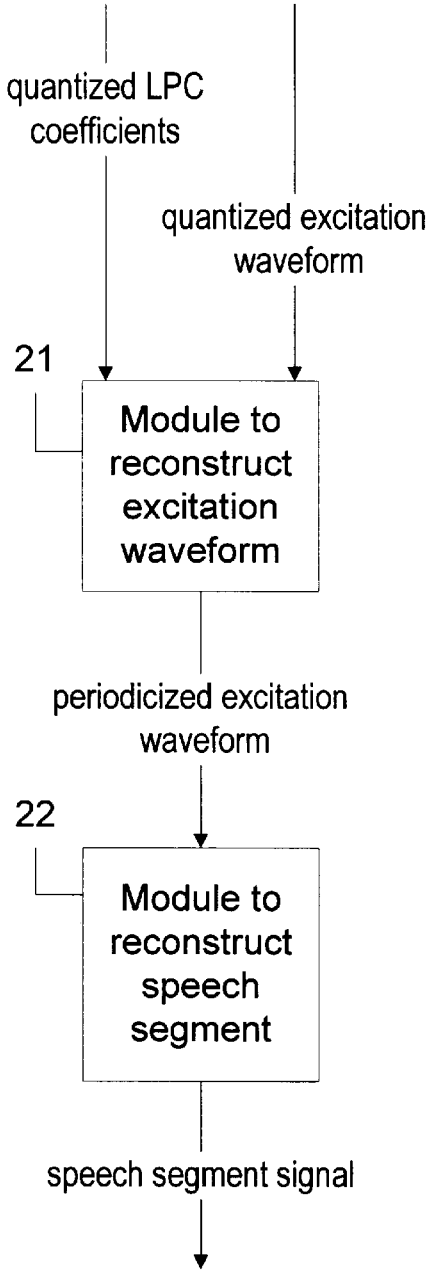
FIG. 3 shows the functional means implemented by a digital signal processor for forming a decoder according to the present invention.

As seen in FIGS. 2 and 3, the present invention can be implemented through a digital signal processor with a suitable control program which provides for the functional operations described herein for both coding (FIG. 2) and decoding (FIG. 3).

Referring now to FIG. 2, speech is input to a speech sampler 11 for providing a sampled speech segment of the same length as the prototype. The sampled speech segment is then provided to an autocorrelator 12 for providing autocorrelation coefficients. These autocorrelation coefficients are then provided to a module 13 to determine a series of LPC coefficients. The LPC coefficients are provided to two different modules: a module 14 to quantize the LPC coefficients and a module 15 to determine the excitation waveform of a synthesis filter. The excitation waveform is provided to a module 16 to quantize the excitation waveform. Thus the output of this coder comprises the quantized LPC coefficients and the quantized excitation waveform.

Referring now to FIG. 3, a decoder is shown for providing the speech segment signal from the output of the coder of FIG. 2. The quantized LPC coefficient and quantized excitation waveform are both provided to a module 21 to reconstruct the excitation waveform, which produces the period-extended excitation waveform. This waveform is provided to a module 22 to reconstruct the speech segment.

While the invention has been described referring to a specific embodiment thereof, it should be noted that it is not to be considered as limited to the illustrated embodiment, said embodiment being susceptible to several modification and variations which will be apparent to those skilled in the art and should be understood as falling within the scope of the accompanying claims.

What is claimed is:

1. A method of coding a sampled voiced speech signal, said voiced speech signal containing a repetition of a prototype waveform, the method comprising the steps of:

a) taking a segment of said sampled voiced speech signal the segment having a length equal to the length of the prototype waveform, and extending the sampled voiced speech signal using the period of the prototype waveform;

b) calculating a series of autocorrelation coefficients of said extended sampled voiced speech signal segment;

c) calculating, from said series of autocorrelation coefficients, a series of linear predictive coding (LPC) coefficients, relative to a synthesis filter the synthesis filter outputting a synthesized waveform when provided as input an excitation waveform;

d) determining the excitation waveform of said synthesis filter in terms of the LPC coefficients and a single phase-adapted pulse, the single pulse phase-adapted so that the signal coming out from said synthesis filter is minimally distorted with respect to said sampled speech signal segment; and e) quantizing said series of LPC coefficients and said excitation waveform.

2. An encoding method according to claim 1, characterized in that said excitation waveform consists of a pulse having a suitable amplitude and position.

3. An encoding method according to claim 2, characterized in that, in determining said amplitude and position, a series of pulses is used in exciting said synthesis filter, so as to bring the response of said filter into steady state.

4. An encoding method according to claim 2, wherein the pulse is defined by spectrum lines, each having a particular frequency, characterized in that a suitable value of phase is assigned to at least one frequency of the spectrum of said pulse.

5. An encoding method according to claim 4, characterized in that each said phase value is discretized according to a grid of suitable values.

6. An encoding method according to claim 4, characterized in that each said phase value is assigned to a frequency group of the spectrum of said pulse according to suitable criteria.

7. An encoding method according to claim 1, further comprising, before acquiring said sampled voiced speech signal, the step of varying the sampling period from an original sampling period, and after said step of quantizing said series of LPC coefficients and said excitation waveform, the step of restoring the original sampling period, wherein the variation is performed so that the length of the prototype waveform segment is an integral multiple of the length of the sampling period resulting from the variation.

8. An encoder for encoding sampled voiced speech, said voiced speech consisting of a periodic repetition of a prototype waveform segment, the encoder comprising:

a) means for taking a segment of said sampled voiced speech of a length equal to the length of the prototype waveform segment and extending the sampled voiced speech signal using the period of the prototype waveform;

b) means for calculating a series of autocorrelation coefficients of said extended sampled voiced speech segment;

c) means for calculating, from said series of autocorrelation coefficients, a series of linear predictive coding LPC) coefficients relative to a synthesis filter the synthesis filter outputting a synthesized waveform when provided an input excitation waveform;

d) means for determining the excitation waveform of said synthesis filter in terms of the LPC coefficients and a single phase-adapted pulse, the single pulse phase-adapted so that the output of said filter is minimally distorted with respect to said sampled speech segment; and e) means for quantizing said series of LPC coefficients and said excitation waveform.

9. A method of decoding an encoded sampled voiced speech signal, the method comprising the steps of:

a) receiving a set of linear predictive coding (LPC) filter parameters;

b) receiving an excitation waveform in terms of excitation parameters, said excitation parameters including amplitude, phase and position information;

c) performing an inverse transform to obtain an unpositioned excitation waveform;

d) receiving a length of a prototype waveform;

e) translating in time the unpositioned excitation waveform to the received position and adjusting its amplitude to the received amplitude to provide an unperiodicized excitation waveform;

f) periodicizing said unperiodicized excitation waveform according to the prototype waveform length;

g) calculating the prototype waveform from the LPC filter parameters and the periodicized excitation waveform;

h) receiving interpolation parameters for prototype waveform interpolation; and i) reconstructing said sampled voiced speech signal by performing prototype waveform interpolation using the interpolation parameters.

10. A decoder for decoding an encoded sample of a sampled voiced speech signal, the decoder comprising:

a) means for receiving a set of linear predictive coding (LPC) filter parameters;

b) means for receiving an excitation waveform in terms of excitation parameters, said excitation parameters including amplitude, phase and position information;

c) means for performing an inverse transform to obtain an unpositioned excitation waveform;

d) means for receiving a length of a prototype waveform;

e) means for translating the unpositioned excitation waveform in time to the received position and adjusting its amplitude to the received amplitude to provide an unperiodicized excitation waveform;

f) means for periodicizing said unperiodicized excitation waveform according to the prototype waveform length;

g) means for calculating the prototype waveform from the LPC filter parameters and the periodicized excitation waveform;

h) means for receiving interpolation parameters for prototype waveform interpolation; and i) means for reconstructing said sampled voiced speech signal by performing prototype waveform interpolation using the interpolation parameters.

* * * * *

UNITED STATES PATENT AND TRADEMARK OFFICE

CERTIFICATE OF CORRECTION

PATENT NO. : 5,809,456

DATED : Sep. 15, 1998

INVENTOR(S) : Cucchi, et al.

It is certified that error appears in the above-identified patent and that said Letters Patent is hereby corrected as shown below: On the title page: Item [54] and Column 1, line 3, In title after "single" --pulse-- should be inserted.

In column 8, line 5, after "signal" --,-- should be inserted.

In column 8, line 14, after "filter" --,-- should be inserted.

In column 8, line 59, after "segment" --,-- should be inserted.

In column 8, line 67, "LPC)" should be --(LPC)--.

In column 8, line 67, after "filter" --,-- should be inserted.

Signed and Sealed this

Thirtieth Day of March, 1999

*Attest:*

Q. TODD DICKINSON

*Attesting Officer*

*Acting Commissioner of Patents and Trademarks*